US008674793B2

(12) United States Patent
Le Youdec

(10) Patent No.: US 8,674,793 B2
(45) Date of Patent: Mar. 18, 2014

(54) POWER CONTACT DEVICE WITH ELECTRODYNAMIC COMPENSATION IN THE PRESENCE OF HIGH CURRENTS

(75) Inventor: Gérald Le Youdec, Evreux (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 13/594,089

(22) Filed: Aug. 24, 2012

(65) Prior Publication Data

US 2013/0049905 A1 Feb. 28, 2013

(30) Foreign Application Priority Data

Aug. 26, 2011 (FR) ..... 11 02610

(51) Int. Cl.
*H01H 75/00* (2006.01)
*H01H 77/00* (2006.01)
*H01H 83/00* (2006.01)

(52) U.S. Cl.
USPC ..... 335/16

(58) Field of Classification Search
USPC ..... 361/192; 335/15, 16, 147, 185, 194, 335/195
See application file for complete search history.

(56) References Cited

U.S. PATENT DOCUMENTS 2,944,129 A * 7/1960 Cole et al. ..... 335/147
4,467,301 A * 8/1984 Goodrich ..... 335/195
4,849,590 A * 7/1989 Becker et al. ..... 218/33
5,694,099 A * 12/1997 Connell et al. ..... 335/78

FOREIGN PATENT DOCUMENTS

EP 1 818 959 A1 8/2007
FR 2 905 795 3/2008

* cited by examiner

*Primary Examiner* — Bernard Rojas
(74) *Attorney, Agent, or Firm* — Steptoe & Johnson LLP

(57) ABSTRACT

A power contact device comprises two stationary and movable contact elements, the two elements being in the form of two juxtaposed coiled turns arranged facing one another in the open position. Each turn is made from a material that is both magnetic and current conducting to constitute a single part acting as power contact, as coil generating a magnetic induction field, and as magnetic circuit performing strengthening and channelling of said magnetic field.

10 Claims, 3 Drawing Sheets

POWER CONTACT DEVICE WITH ELECTRODYNAMIC COMPENSATION IN THE PRESENCE OF HIGH CURRENTS

BACKGROUND OF THE INVENTION

The invention relates to a power contact device of an electric control apparatus comprising:

- at least a first stationary contact element and a second movable contact element designed to occupy a closed position in which they are in electric contact for establishment and flow of the current, and an open position in which the two contact elements are separated from one another interrupting flow of the current,
- and electrodynamic compensation means for keeping the contact elements in the closed position when a short-circuit current occurs, said compensation being performed by means of the electrodynamic attraction effect due to flow of the current taking place in the same direction in the two contact elements.

The electric control apparatus does not have any breaking capacity but its contacts must imperatively remain closed in the presence of a short-circuit, which is eliminated by a protective circuit breaker connected line-side.

STATE OF THE ART

To guarantee this immunity of the contacts when a short-circuit occurs, it is known to compensate the electrodynamic repulsion force exerted between the contacts by an opposing electrodynamic force exerted in the opposite direction.

The force exerted on the movable contact is directly proportional to the square of the current, but inversely proportional to the distance between the contacts. This distance must not be too large to have a significant effect on small or medium over-currents. In the case of large short-circuit currents on the other hand, the electrodynamic forces are high and could deform copper contact parts.

The document FR2905795 concerns a contact device comprising two separable contact elements extending in parallel manner to one another in the closed position, each being equipped with a pair of contact pads. In the closed position, the two contact elements are arranged facing one another, and are electrically connected in parallel, so that the current is shared between the two contact elements, flowing in the same direction in the latter. This results in electrodynamic attraction forces which keep the contact pads closed. These forces are not affected by a possible magnetic circuit saturation, as everything takes place in air. On large short-circuit currents, the attraction forces are very high and could deform contact elements with elongate branches. Such a contact device further requires two contact pads per contact element, which increases the manufacturing cost.

Another known solution consists in making use of a U-shaped magnetic circuit to keep the contacts closed. This results in limitation of the attraction forces due to saturation, but the volume of the current interruption chambers is increased.

OBJECT OF THE INVENTION

The object of the invention consists in providing a power contact device of small size with improved electrodynamic compensation independently from the current intensity.

The contact device according to the invention is characterized in that the two stationary and movable contact elements are in the form of two juxtaposed coiled turns arranged facing one another in the open position, each turn being made from a material that is both magnetic and current conducting to constitute a single part acting as power contact, as coil generating a magnetic induction field, and as magnetic circuit performing reinforcing and channelling of said magnetic field.

In the closed position, when the current flows from the movable contact element to the stationary contact element, a coil is obtained with two turns in series, resulting in formation of a magnetic field channelled by the turns themselves, since they also act as magnetic circuit. This results in electrodynamic attraction forces between the mobile turn and the fixed turn which keep the contacts closed in the case of a short-circuit or overcurrent. Such a contact device requires few parts to obtain the desired compensation force. The two turns further enable limiting of the electrodynamic forces following saturation of the magnetic material, which prevents deformation of the contact elements on strong currents.

The electric control apparatus can be a power switch, a contactor, or a reversing switch.

According to one feature of the invention, the first contact element and the second contact element are made either from a steel metallic material or by sintering of a magnetic metal powder with a thermoplastic binder.

According to another feature of the invention, the two coiled turns of the first stationary contact element and of the second movable contact element extend in two parallel planes in the open position, the second movable contact element being mounted pivotally on a vertical axis.

According to a preferred embodiment, the second movable contact element is inserted between the first stationary contact element and a third stationary contact element to constitute a current-reversing contact device with two closed positions situated on each side of the median open position. The third stationary contact element is in the shape of a coiled turn made from the same material as that of the coiled turn of the first stationary contact element, and extending in parallel manner to the latter.

Such a contact device is applied to a three-phase reversing switch enabling the direction of rotation of a three-phase electric motor to be reversed by reversing the connection between two phases. The contacts of this reversing switch remain closed in the presence of a short-circuit.

The poles of the reversing switch are housed in three juxtaposed compartments of a case made from insulating material, in which:

- the first stationary contacts of the two end poles are electrically inter-connected by a first connecting conductor in connection with a first connection terminal,
- the third stationary contacts of the two end poles are interconnected by a second connecting conductor in connection with a third connection terminal.

The two connecting conductors are parallel and insulated from one another, and a pass-through conductor without a current interruption gap is advantageously integrated in the intermediate pole.

BRIEF DESCRIPTION OF THE DRAWINGS

Other advantages and features will become more clearly apparent from the following description of an embodiment of the invention given for non-restrictive example purposes only and represented in the appended drawings, in which.

DETAILED DESCRIPTION OF THE INVENTION

Figure 1:
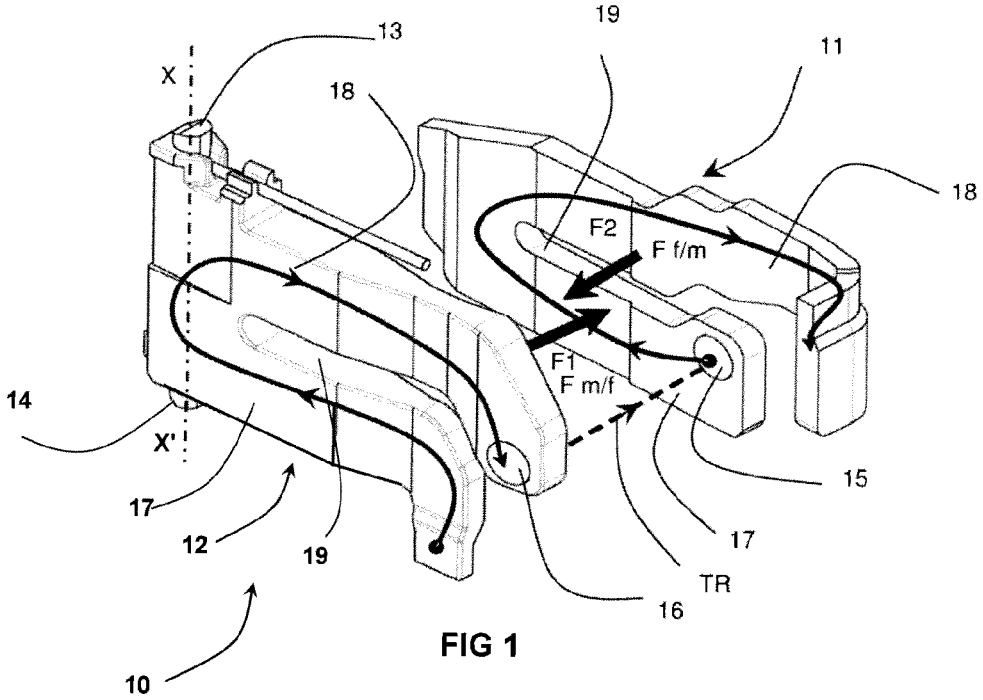
FIG. 1 is an exploded perspective view of a contact device according to the invention, comprising a single stationary contact element.

In FIG. 1, a power contact device 10 for an electric control apparatus comprises a first stationary contact element 11 and a second movable contact element 12. The latter is mounted pivoting around a vertical axis XX' delineated by two opposite ends 13, 14 aligned in the vertical direction. The first stationary contact element 11 is provided with a contact pad 15 arranged facing another contact pad 16 securedly affixed to second movable contact element 12. The two contact pads 15, 16 are able to occupy either a closed position in which they are in electric contact for establishment and flow of the current, or an open position in which contact pad 16 separates from the other contact pad 15 after pivoting of second movable contact element 12. This separation of the contacts interrupts flow of the current.

The opening and closing operations of contact device 10 are performed by means of an operating mechanism (not shown) housed in the case of the electric apparatus. This control function apparatus, in particular of switch, contactor, or reversing switch type, does not have any breaking capacity, and contact elements 11, 12 absolutely must remain in the closed position in the presence of a high-intensity current liable to generate electrodynamic repulsion forces between contact pads 15, 16.

To compensate these repulsion forces in the event of an overcurrent, stationary contact element 11 and mobile contact element 12 are both in the form of a coiled turn made from a material that is both magnetic and current conducting. For example purposes, this material can be made from steel by increasing the cross-section with respect to a conventional copper conductor for reasons of overheating.

It can also be produced by the MIM method consisting in mixing fine magnetic metallic powder with a thermoplastic binder in order to obtain granules of material able to be transformed by thermoplastic moulding. The part obtained in this way is placed in a furnace to eliminate the thermoplastic binder, which escapes in the form of gas. The temperature increase of the furnace enables sintering of the part to be obtained giving the latter the cohesion and structure of a metal part.

The two coiled turns of first stationary contact element 11 and of second movable contact element 12 extend in two parallel planes in the open position, being separated from one another by a reduced isolating distance suitable for a good dielectric strength. Each coiled turn presents a bottom branch 17 and a top branch 18 which are separated from one another by an elongate slot 19 which extends orthogonally to the vertical direction of the axis XX' of pivoting of second movable contact element 12.

Each coiled turn, made from magnetic current conducting material, forms a single part playing the combined role of power contact, of coil generating a magnetic induction field, and of magnetic circuit reinforcing and channelling said magnetic field.

In FIG. 1 which shows an exploded perspective view of contact device 10, it can be imagined that the two contact elements 11, 12 are in electric contact via their contact pads 15, 16. The broken line TR symbolizes flow of the current in the closed position when contact pad 16 is in engagement against stationary contact pad 15. It can be noted that the direction of current flow is the same in the bottom branches 17 of the two loops. The same is the case in the two top branches 18 of the two loops. Such a current flow causes an electrodynamic attraction effect between the two loops when a short-circuit current occurs. Attraction forces F1 and F2 are proportional to the square of the current, and enable the repulsion forces exerted at the level of contact pads 15, 16 by the same current to be compensated. Maintaining of contact elements 11, 12 in the closed position is thus guaranteed in the presence of a short-circuit current. The latter is eliminated after operation of a protective circuit breaker placed line-side with respect to the power supply source.

Attraction forces F1 and F2 are further reinforced by the magnetic circuit formed by the two adjacent magnetic material loops. This magnetic circuit channels and concentrates the force lines of the magnetic field generated by the coil of the two coiled turns in series, so as to obtain an optimal attraction effect.

Such a structure with electrodynamic compensation of contact device 10 can be fitted in any electric apparatus that does not have to react in the presence of a short-circuit current, in particular a switch, a contactor or a reversing switch.

Figure 2:
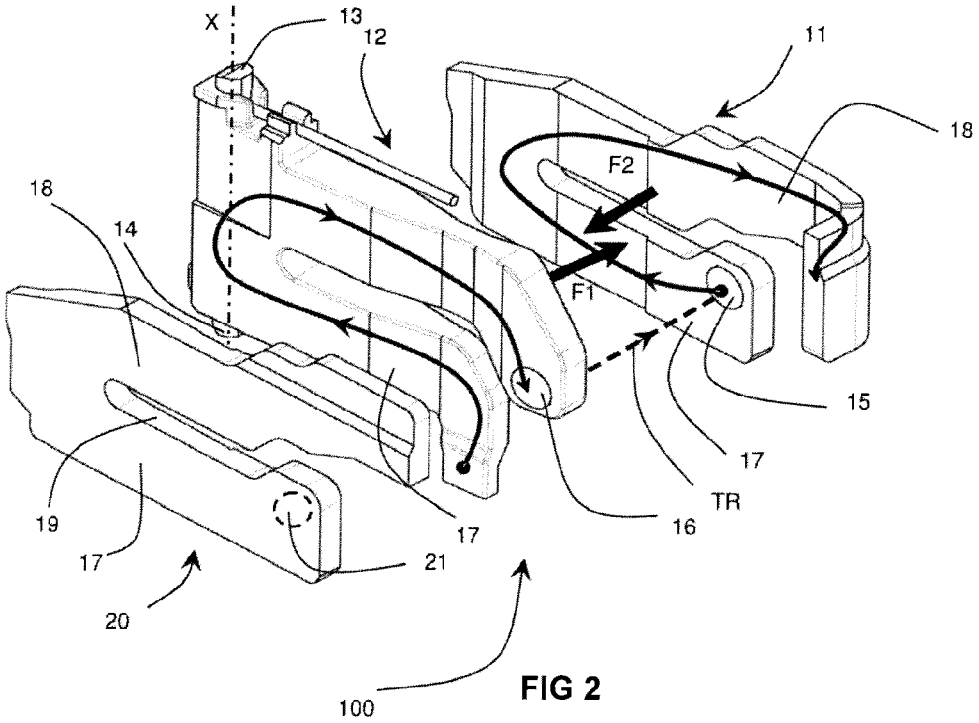
FIG. 2 represents an identical view of an alternative embodiment of the invention with a double contact device equipped with a pair of stationary, contacts of reversing switch type.

With reference to FIG. 2, the same reference numerals will be used to designate similar parts to those of contact device 10 of FIG. 1. Second movable contact element 12 is inserted between first stationary contact element 11 and a third stationary contact element 20 to form a current-reversing contact device 100 with two closed positions situated on each side of the median open position. Third stationary contact element 20 is in the form of a coiled turn made from the same material as that of the coiled turn of first stationary contact element 11 and extending in parallel manner to the latter. Contact pad 16 of second movable contact element 12 can come into contact either with contact pad 15 of first stationary contact element 11 or with contact pad 21 of third stationary contact element 20 (shown in a broken line).

It can be imagined in FIG. 2 that the two contact elements 11, 12 are in electric contact via their contact pads 15, 16. The broken line TR symbolizes flow of the current in the closed position, and the direction of current flow is identical to that of FIG. 1, with the same attraction forces F1 and F2 for electrodynamic compensation. In the other state of reversing-switch contact device 100, second movable contact element 12 pivots in the revere direction so that contact pad 16 comes into engagement against contact pad 21 of third stationary contact element 20. In this case a coil with two coiled turns in series is also to be found, with the same electrodynamic attraction forces for holding in the closed position.

Figure 3:
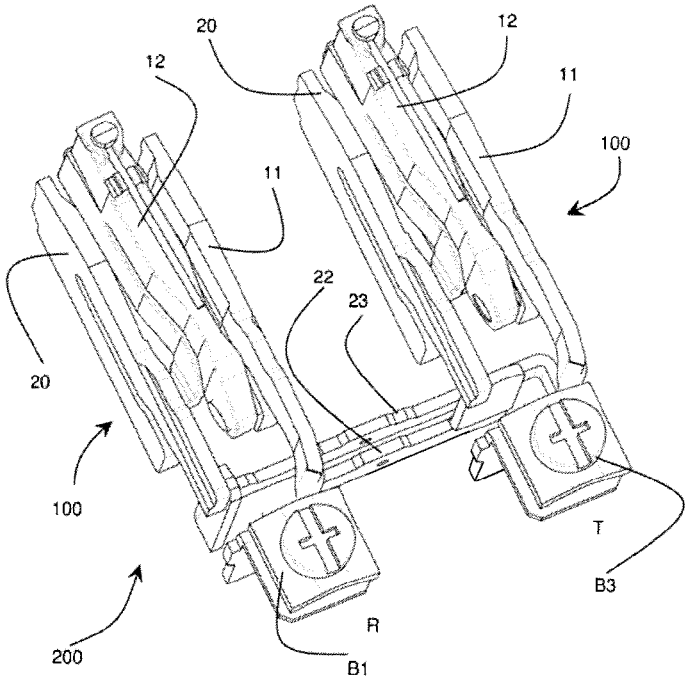
FIG. 3 shows a contact device of two end poles of a three-phase reversing switch using the contact device of FIG. 2 in each pole.

FIG. 3 shows contact device 200 of two end poles R,T of a three-phase reversing switch, using contact device 100 of FIG. 2 in each pole.

First stationary contact elements 11 of the two end poles R,T are electrically interconnected by a first connecting conductor 22 connected with a first connection terminal B1.

Third stationary contact elements 20 of the two end poles R,T are interconnected by a second connecting conductor 23 connected with third connection terminal B3.

The two connecting conductors 22, 23 are parallel and insulated from one another.

Figure 4:
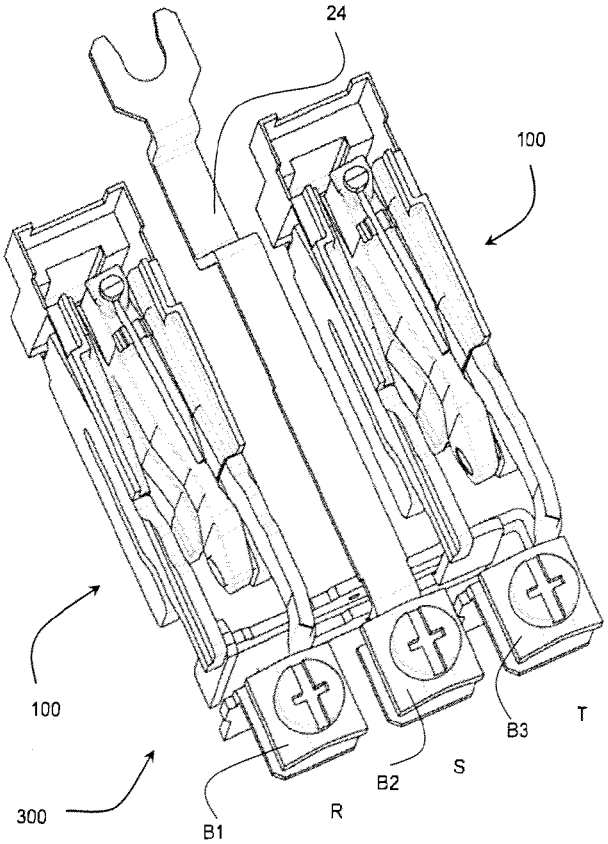
FIG. 4 represents a contact device with the three poles of a three-phase reversing switch, which uses the contact device of FIG. 3, with in addition a pass-through conductor integrated in the intermediate pole.

FIG. 4 represents a contact device 300 with the three poles R,S,T of a three-phase reversing switch, which uses contact device 200 of FIG. 3, with in addition a pass-through conductor 24 without a current interruption gap integrated in intermediate pole S. This conductor 24 is formed by a continuous contact part connected with a second connection terminal B2, which is arranged between first and third terminals B1, B2 of the reversing switch.

Figure 5:
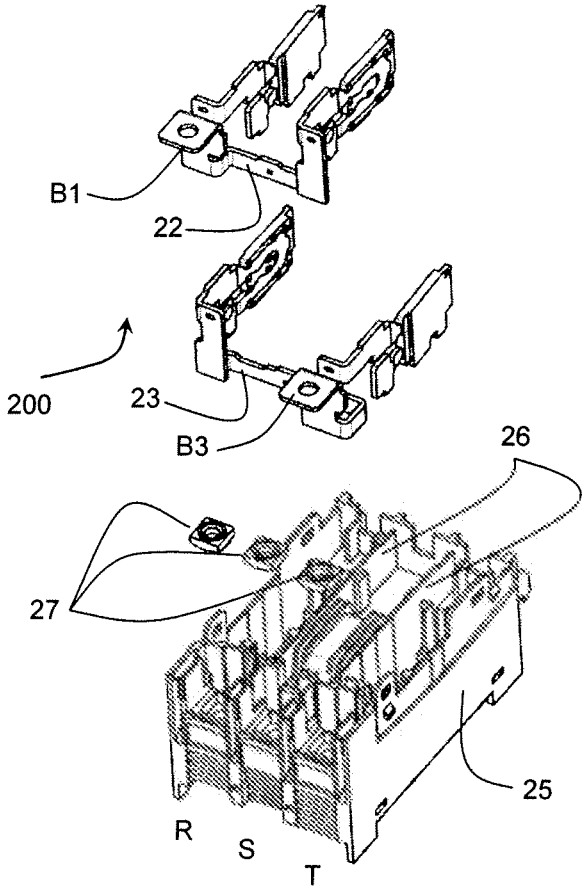
FIG. 5 is an exploded perspective view of a three-phase reversing switch the poles of which are housed in three juxtaposed compartments of a case made from insulating material.

FIG. 5 is an exploded perspective view of a three-phase reversing switch the poles R,S,T of which are housed in three juxtaposed compartments of a case 25 made from insulating material. The compartments are insulated from one another by vertical separating walls 26, and contact device 200 is inserted in the end poles R,T via the top of the case 25 which is open. Nuts 27 perform fixing of contact strips of contact device 200 in the poles. Final assembly of the reversing switch is then performed by fitting the pass-through conductor 24 in intermediate pole S, followed by fitting of the actuating mechanism and cover (not shown).

The invention claimed is:

1. A power contact device for an electric control apparatus, said device comprising:

a first stationary contact element, and a second movable contact element movable between a closed position in which said contact elements are in electric contact for permitting flow of current between contact points on each of said contact elements, and an open position in which said contact elements are separated from one another for interrupting said flow of current between said contact points, wherein the contact elements are each in the form of a loop of material that is both magnetic and electric current conducting, each of said contact element loops is located in a separate plane and said separate planes are substantially parallel to each other, for electrodynamic compensation for keeping the contact points in closed position by electrodynamic attraction effect caused by flow of current in the same direction in said contact element loops.

2. The contact device according to claim 1, wherein the first stationary and second movable contact elements comprise steel.

3. The contact device according to claim 2, wherein the first stationary contact element and second movable contact element comprise a sintered magnetic metal powder.

4. The contact device according to claim 1, wherein said second movable contact element is mounted pivotally on a vertical axis.

5. The contact device according to claim 1 additionally comprising a stationary third contact element, wherein the second movable contact element is located between said first stationary contact element and said stationary third contact element for current-reversing contact in one of two closed positions situated on each side of a median open position.

6. At least two contact devices according to claim 5, in combination with a three-phase reversing switch, the three-phase reversing switch comprising two end poles and an intermediate pole, first, second and third connection terminals, a case having three compartments, wherein each end pole and at least one of said contact devices are housed in one of said compartments, and the case is made from insulating material, wherein:

the first stationary contact elements of the devices housed with each of the two end poles are electrically interconnected by a first connecting conductor connected with the first connection terminal, the stationary third contact elements of the devices housed with each of the two end poles are interconnected by a second connecting conductor connected with the third connection terminal, and the two connecting conductors are parallel and insulated from one another.

7. The contact devices with three-phase reversing switch according to claim 6, wherein the intermediate pole comprises a pass-through conductor connected between the second movable contact elements of the devices and the second connection terminal which is located between the first and third connection terminals of the reversing switch.

8. An electric switch comprising the contact device according to claim 1.

9. An electric contactor comprising the contact device according to claim 1.

10. An electric reversing switch comprising the contact device according to claim 1.

* * * * *